United States Patent [19]

Ottos

[11] 4,189,814

[45] Feb. 26, 1980

[54] APPARATUS AND METHOD FOR AUTOMATICALLY ALIGNING A MULTIBEAM ELECTRON GUN ASSEMBLY WITH A CATHODE-RAY TUBE BULB

[75] Inventor: James G. Ottos, Lancaster, Pa.

[73] Assignee: RCA Corporation, New York, N.Y.

[21] Appl. No.: 939,497

[22] Filed: Sep. 5, 1978

[51] Int. Cl.[2] ..... H01J 9/18

[52] U.S. Cl. ..... 29/25.16; 316/23; 316/29

[58] Field of Search ..... 316/23, 29; 29/25.15, 29/25.16; 250/231 SE; 356/400

[56] References Cited

U.S. PATENT DOCUMENTS

| | | | |
|---|---|---|---|
| 3,997,782 | 12/1976 | Willits | 250/231 SE |
| 4,056,722 | 11/1977 | Ray | 250/231 SE |
| 4,145,608 | 3/1979 | Shirasaki et al. | 250/231 SE |
| 4,148,117 | 4/1979 | Bracke et al. | 316/23 X |

*Primary Examiner*—Richard B. Lazarus

*Attorney, Agent, or Firm*—E. M. Whitacre; G. H. Bruestle; D. H. Irlbeck

[57] ABSTRACT

An electrode of the electron gun assembly has two accurately positioned alignment apertures therein, a line connecting the centers of the alignment apertures being transverse to the central longitudinal axis of the gun assembly. The alignment method includes holding the electron gun assembly relative to the cathode-ray tube envelope and directing a collimated light source toward the alignment apertures. Next, the position of the electron gun assembly is rotationally stepped about its central longitudinal axis while the light source is pulsed in coordination with the steps in position of the electron gun assembly. During the rotation, the number of light pulses passing through the alignment apertures are counted up. Thereafter, the stepping direction of the electron gun assembly is reversed and the number of light pulses passing through the alignment apertures are counted down. The reverse rotation of the electron gun assembly is stopped when the number of counted down light pulses are half of the maximum number of light pulses counted up.

10 Claims, 7 Drawing Figures

APPARATUS AND METHOD FOR AUTOMATICALLY ALIGNING A MULTIBEAM ELECTRON GUN ASSEMBLY WITH A CATHODE-RAY TUBE BULB

BACKGROUND OF THE INVENTION

This invention relates to an apparatus and a method for assembling a cathode-ray tube bulb assembly and mount assembly, and particularly, to a method of aligning a multibeam electron gun assembly in a cathode-ray tube bulb.

In a commercial cathode-ray tube such as a color television picture tube of the apertured mask type having a three-color viewing screen structure, the viewing screen structure is photographically printed using light centers simulative of the position of the deflection center of each of the three electron beams in the final tube. A mount assembly comprising a three beam electron gun is subsequently installed in the tube. During the assembly of the electron gun structure in the tube bulb, the axis of each electron beam path must be oriented to coincide with the light centers used to print the viewing screen structure within a desired rotational tolerance about the central longitudinal axis of the tube. In commercial color television picture tubes using dynamic convergence circuitry, a mount assembly, including an electron gun assembly having three cathodes in fixed orientation, ordinarily must be positioned in the tube within three degrees of rotation. In a commercial color television picture tube using no dynamic convergence circuitry or simplified dynamic convergence circuitry, a more accurate rotational positioning of the mount assembly to about one half degree is usually required.

In one prior method for assembling a multi-beam electron gun structure, the alignment is accomplished by several separate assembly operations. During the mount assembly operation, the central longitudinal axis of the electron gun assembly is aligned with the stem axis and the cathode axes are rotationally aligned with the stem leads. Then, the electron gun assembly is attached to the stem leads with metal wires and ribbons to form a mount assembly. In the subsequent mount sealing operation, the preassembled mount assembly is positioned and oriented with respect to the bulb assembly and then sealed to the bulb assembly on a sealing unit. In this mount sealing operation, the mount assembly is held rotationally with the stem leads positioned within aligned holes on the sealing machine. Since the holes include a clearance for loading and the mount assembly includes assembly tolerances, the rotational alignment of the mount assembly with respect to the screen structure can only be maintained within about three degrees of rotation. In addition, since the mount assembly is preassembled and transported to the sealing machine, the fragile wires supporting the electron gun assembly may be accidentally bent thereby misaligning the electron gun assembly with the stem leads. This may result in an angular misalignment of the electron gun assembly when the stem leads are used to angularly align the mount assembly with the bulb assembly.

In another prior method for assembling a multibeam electron gun structure, as described in U.S. Pat. No. 3,807,006 issued to Segro et al., the alignment is accomplished by mechanically sensing the position of the electron gun assembly with respect to the bulb assembly. While this method is an improvement in that it obviates the necessity to align the electron gun assembly with the stem axis which is in turn aligned with respect to the bulb assembly, this method entails the necessity of physically contacting the electron gun assembly thereby introducing its own errors into the total alignment error.

In yet another method of assembling a cathode ray tube having a bulb assembly and a mount assembly, described in U.S. Pat. No. 3,962,764 issued to Stewart et al. on June 15, 1976, the bulb assembly first is positioned in a predetermined orientation. Next, the mount assembly, which includes a multibeam electron gun assembly, is positioned in a location spaced from the bulb assembly with the central longitudinal axis of the mount assembly coincident with the central longitudinal axis of the bulb assembly. Next, the rotational position of the electron gun assembly about the coincident longitudinal axis is optically sensed with respect to the positioned bulb assembly by use of split images. The mount assembly is then rotated about the coincident longitudinal axis until the split images are aligned thus indicating that the electron gun assembly is at a prescribed rotational orientation with respect to the bulb assembly. Then, while maintaining this rotational orientation, the mount assembly is moved along the longitudinal axis to a desired longitudinal location with respect to a faceplate panel of the bulb assembly at which time the mount assembly is then permanently fixed to the bulb assembly.

SUMMARY OF THE INVENTION

The present invention includes apparatus and method for aligning a multibeam cathode-ray tube electron gun assembly with at least a portion of a cathode-ray tube bulb, wherein an element of the gun assembly has two accurately positioned alignment apertures therein, a line connecting the centers of the alignment apertures being transverse to the central longitudinal axis of the gun assembly. The method includes directing light rays toward the alignment apertures and rotating the electron gun assembly about its central longitudinal axis while the light rays are pulsed in predetermined relationship with the speed of rotation of the electron gun assembly. During the rotation, the number of light pulses passing through the alignment apertures are counted. Thereafter in one embodiment, the stepping direction of the electron gun assembly is reversed and the number of light pulses passing through the alignment apertures again are counted. The reverse rotation of the electron gun assembly then is stopped when the number of counted light pulses during reverse rotation are half of the maximum number of light pulses counted during forward rotation.

DETAILED DESCRIPTION

Figure 1:
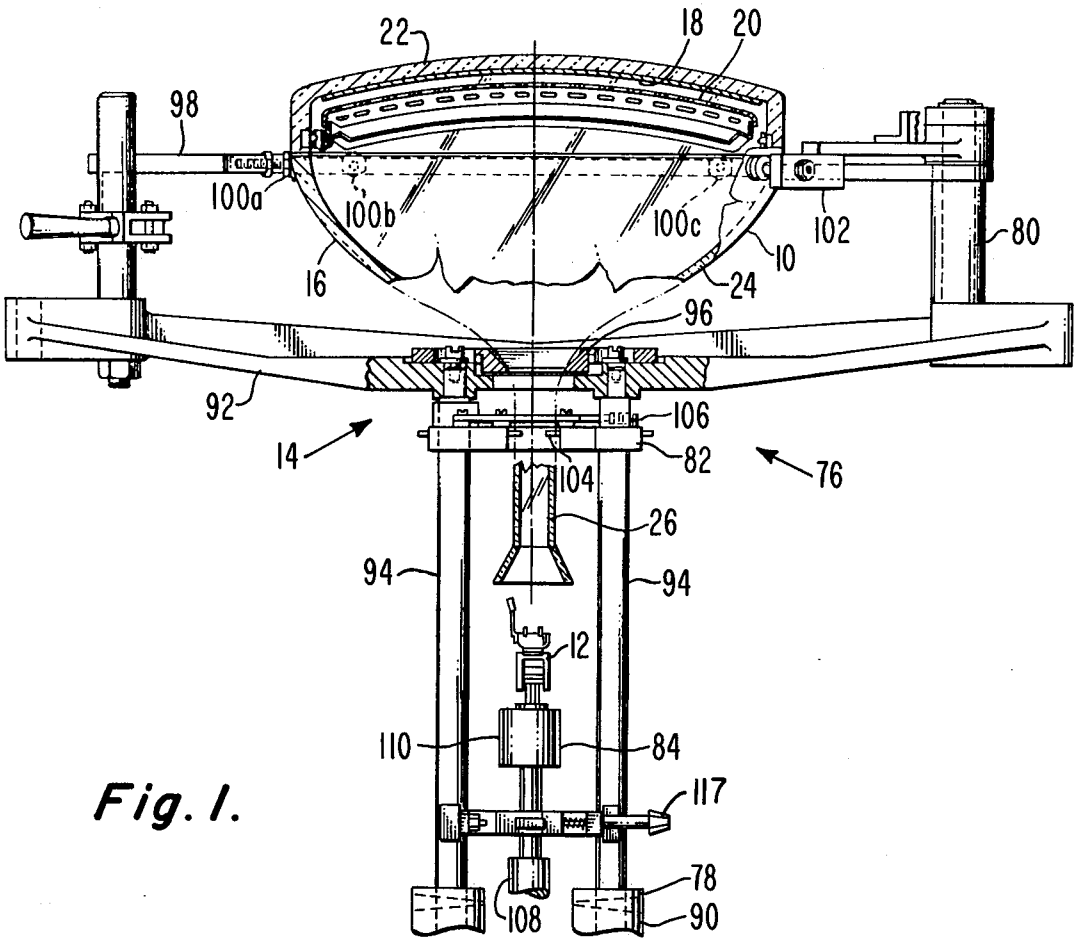
FIG. 1 is a broken-away elevational view partly in section of a bulb assembly and a mount assembly for a cathode ray tube positioned on a head assembly of a mount sealing unit.

FIG. 1 illustrates a sectional view of a cathode-ray tube bulb assembly 10 and an electron-gun mount assembly 12 for a color television picture tube of the apertured-mask type positioned on an apparatus known in the art as a mount sealing unit 14 (only partially shown). The mount sealing unit 14 is used to install the electron-gun assembly 12 in a precise location and orientation within the bulb assembly 10 to make a cathode-ray tube such as a color television picture tube.

The cathode-ray tube bulb assembly 10 comprises a glass envelope 16, a three-color phosphor viewing screen structure 18 and an apertured-mask electrode 20. The glass envelope 16 includes a rectangular faceplate portion 22, a funnel portion 24 and a neck portion 26. The viewing screen structure 18 in the illustrated embodiment is a line-screen structure with phosphor lines extending parallel to the minor or vertical axis of the faceplate 22.

The apertured-mask electrode 20 is positioned in the envelope 16 in a predetermined spaced relationship with the viewing screen structure 18. The apertured-mask electrode 20 used with the line-screen structure 18 includes slit-shaped apertures positioned parallel to the phosphor lines of the viewing screen structure 18.

Figure 2:
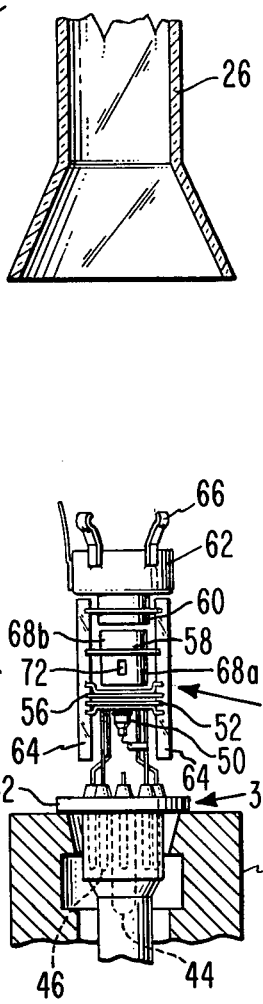
FIG. 2 is an enlarged elevational view partly in section of a portion of a FIG. 1 further illustrating a mount assembly positioned on a mount support assembly of the mount sealing unit.

As shown in FIG. 2, the mount assembly 12 comprises a stem assembly 38 and a multibeam electron gun assembly 40. The stem assembly 38 includes a wafer-shaped stem 42, an exhaust tubulation 44 and stem leads 46. The stem leads 46 extend through the stem 42 and are located on the circumference of a circle which is concentric with the central longitudinal axis of the mount assembly 12. The multibeam electron gun assembly 40 includes three cathodes 50, a control grid 52 (G1), a screen grid 56 (G2), a first accelerating and focusing grid 58 (G3), a second accelerating and focusing grid 60 (G4) and a tubular shield 62. The various grids are mounted on glass support rods 64. The shield 62 also includes bulb spacers 66 for centering the gun assembly within the neck portion 26.

The multibeam electron gun assembly 40 is preferably of the type known in the art as "in-line". An in-line electron gun assembly includes three spaced coplanar cathodes, one for each electron beam. In one preferred in-line electron gun assembly, such as described in U.S. Pat. No. 3,772,554 issued to R. H. Hughes, the grid electrodes for all three cathodes are each formed in one piece. For example, the G1 52, G2 56, G3 58 and G4 60 are each one piece, each piece having three apertures, one for each electron beam.

In the in-line electron gun assembly 40 shown in FIG. 2, the G3 58 is formed in the shape of a lower cup 68*a* and an upper cup 68*b* attached at their open ends. Each of the cups includes three in-line apertures, one for each of the three cathodes 50. The lower cup 68*a* is formed with a pair of accurately positioned narrow alignment apertures or slits 72 on opposite sides thereof. The narrow slits 72 lie within a plane formed by a center line 74 through the electron beam apertures and the central longitudinal axes of the gun assembly. The central longitudinal axis of the gun assembly 12 is also coincident with the axis of the center cathode. A line connecting the centers of the alignment apertures is transverse to the central longitudinal axis of the gun assembly. Although the alignment apertures are described as being formed within a particular electrode, it should be understood that they may be formed in any gun element. Furthermore, the apertures could be two end openings of a bore through a gun element.

It is preferred that a multi-head rotary sealing unit 14, partially shown in FIG. 1, be used to practice the method disclosed herein. The rotary unit includes separate processing stations for loading, preheating, sealing, annealing, and unloading. The sealing unit 14 includes a rotatable head assembly 76, having a central longitudinal axis for each processing station. The head assembly 76 includes a support-frame assembly 78, a bulb alignment assembly 80, a neck chuck 82, and a rotatable gun support assembly 84.

The support-frame assembly 78 includes a lower support 90 and an upper support 92. The lower support 90 is rotatably mounted on the mount sealing unit in bearings (not shown). The lower support 90 includes two vertical support rods 94. The upper support 92 is mounted on top of the two support rods 94. The upper support 92 includes a bulb support member 96 formed to hold the bulb assembly at a specified diameter on the funnel portion 24 known as the yoke reference line.

The bulb alignment assembly 80 is also mounted on the upper support 92. The bulb alignment assembly 80 includes a C-shaped support 98 having three reference units 100*a*, 100*b*, and 100*c* for orienting the bulb assembly 10 and a bulb clamp assembly 102 for retaining the bulb assembly 10 against the three reference units as shown in FIG. 1. The neck chuck 82 is mounted on the two vertical rods 94. The neck chuck 82 comprises two jaws 104 and actuating means 106 for equally moving the jaws.

As shown in FIG. 1, the gun support assembly 84 is mounted on the lower support 90. The gun support assembly 84 includes a seal spindle 108 and gun holder 110. The seal spindle 108 is slidably mounted in the lower support 90. The lower end of the seal spindle 108 slides on a vertically displaced track (not shown) during indexing of the sealing unit 14.

Figure 3:
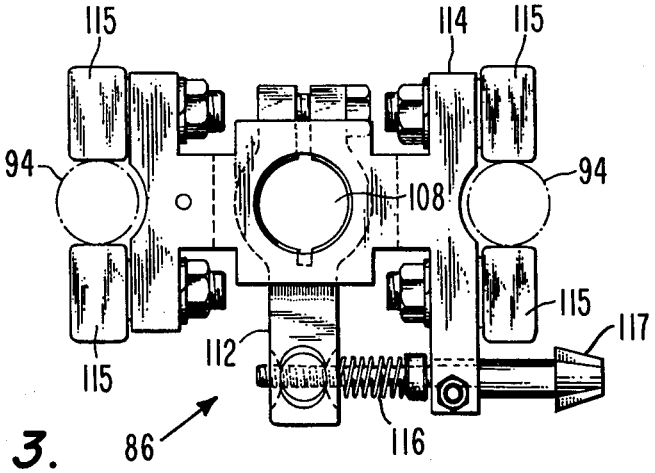
FIG. 3 is a plan view of a mount rotating fixture.

The mount rotating fixture 86 is mounted on the mount seal spindle 108 of the mount support assembly 84. The mount rotating fixture 86 is constructed to slidably contact the two vertical support rods 94 to prevent undesired rotational movement of the mount support assembly 84 about the central longitudinal axis while permitting longitudinal movement. As shown in FIG. 3, the mount rotating fixture 86 comprises a spindle alignment arm 112 which is rigidly fastened to the mount seal spindle 108 and a fixture body 114 having rollers 115 which roll along the two vertical support rods 94. The rotational adjusting means comprises an adjusting knob 117 on an alignment screw 116 which extends through the fixture body 114 and engages a threaded portion on the spindle alignment arm 112 to rotate with respect to the fixture body 114. The rotational adjusting means controls the rotational orientation of the spindle alignment arm 112 about the central longitudinal axis of the gun mount assembly.

Figure 5:
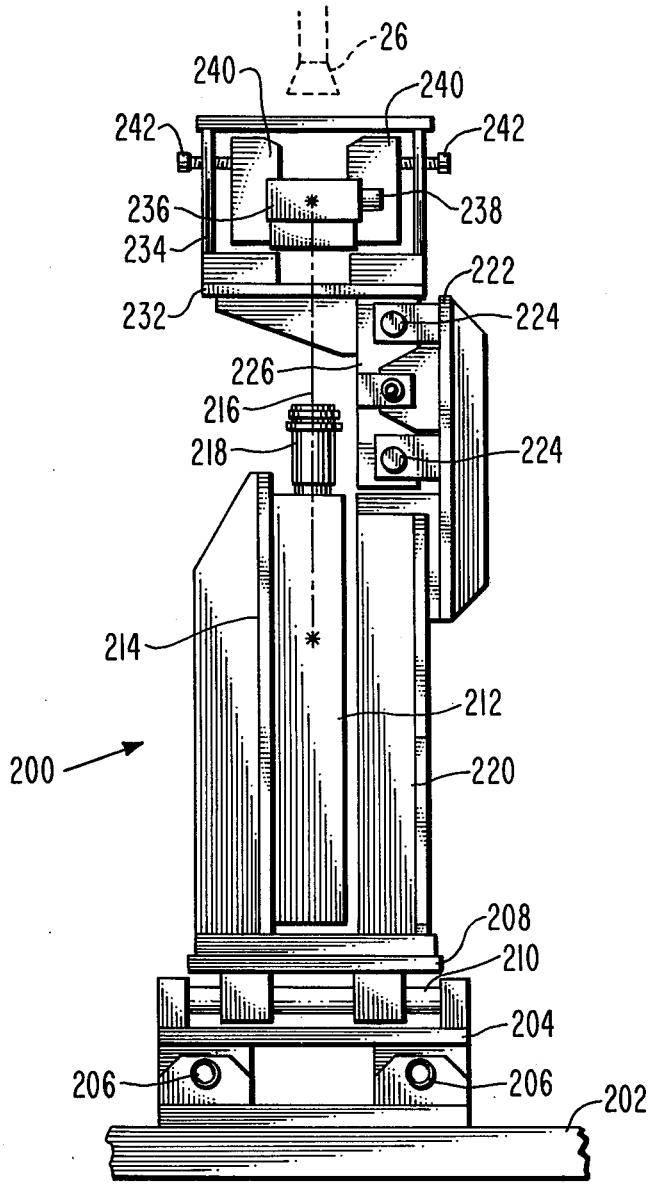
FIGS. 5 and 6 are elevational front and side views of an optical assembly.
Figure 6:
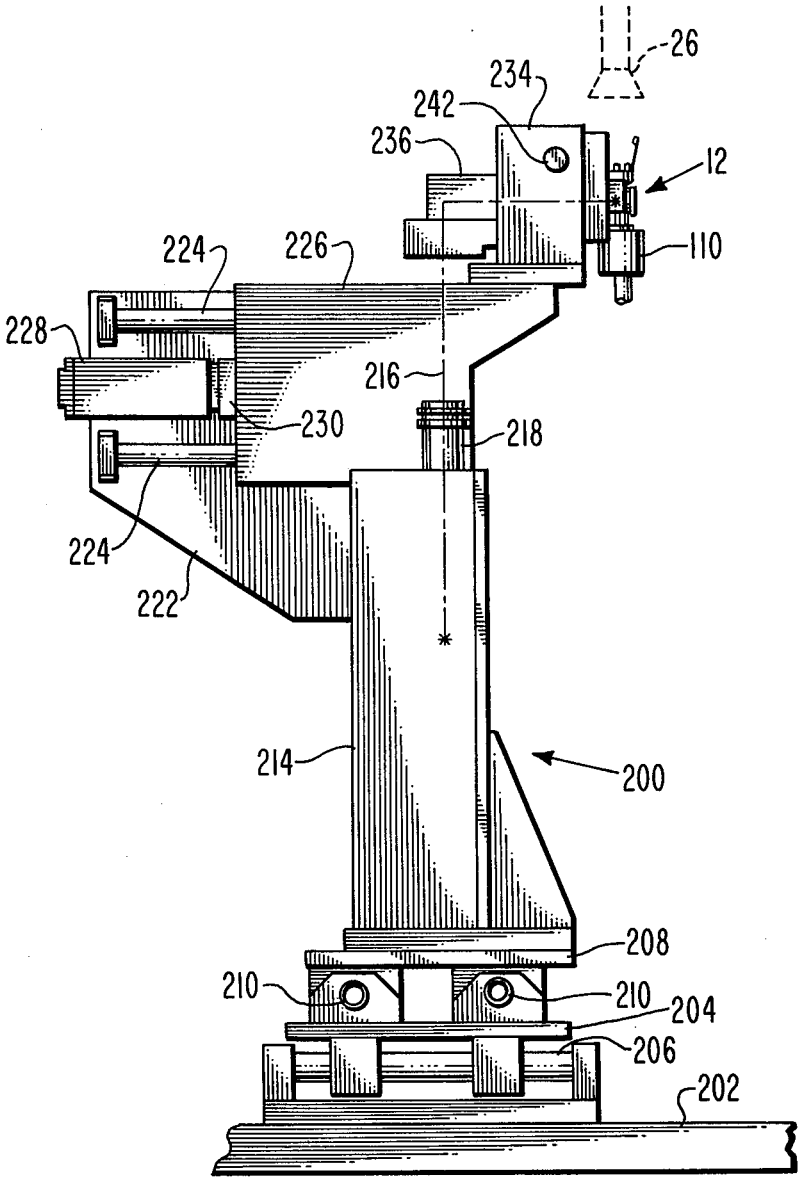
Figure 7:
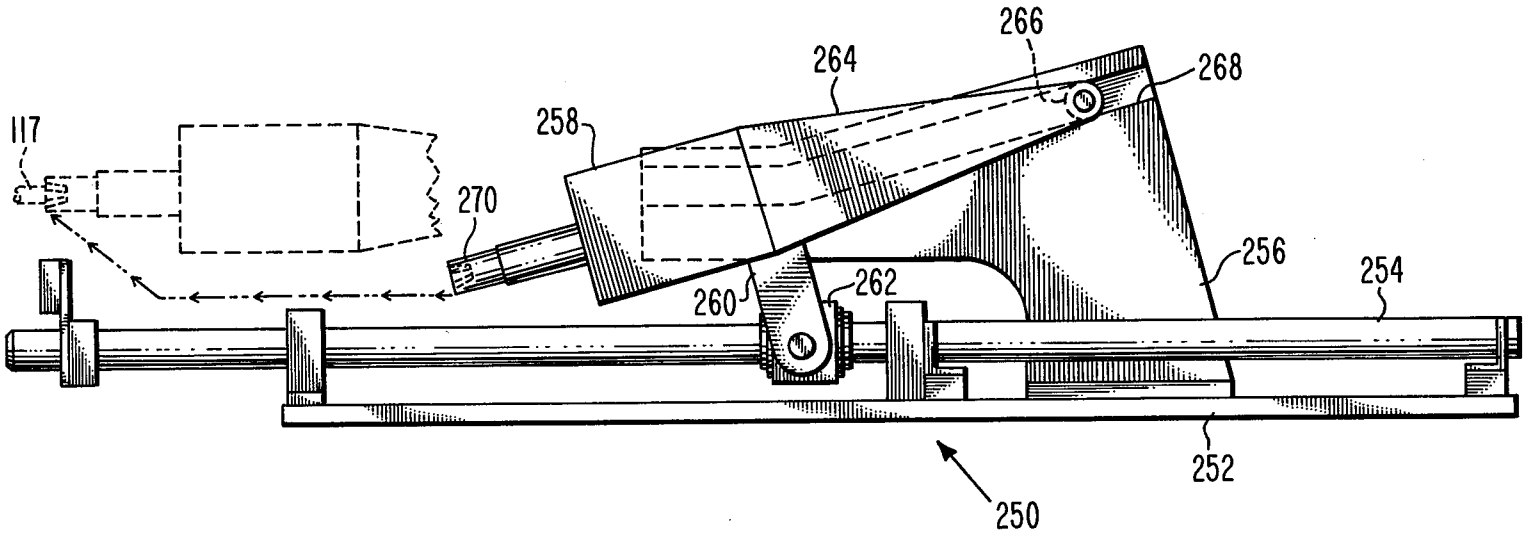
FIG. 7 is a plan view of a stepping motor assembly.

An electron gun assembly alignment apparatus is positioned at one of the stations of a sealing unit. Generally, the alignment apparatus includes two mechanical units along with associated electronics and optical subassemblies. One of the mechanical units, called the optical assembly in the later description with respect to FIGS. 5 and 6, is positioned directly in front of a sealing unit station and the other unit, called the stepping motor assembly, described with respect to FIG. 7, is located to one side of the optical assembly. When a head assembly of the sealing unit holding both a tube bulb and a gun assembly arrives at the alignment station, a portion of the optical assembly is activated to move into position relative to the gun assembly and the stepping motor is moved into engagement with the adjusting knob 117 on aforementioned mount rotating fixture 86. Details of each of these units will be described hereinafter.

Figure 4:
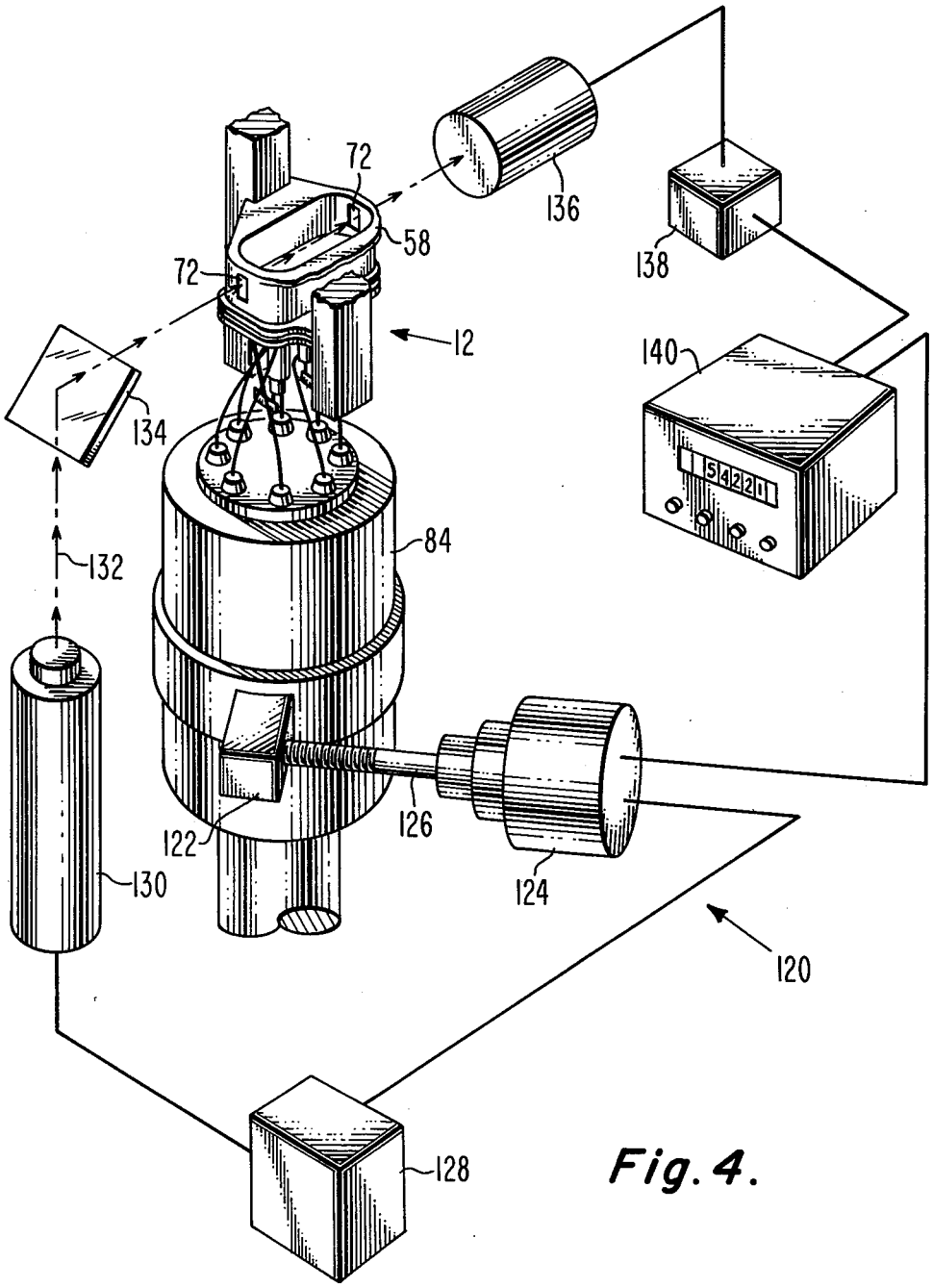
FIG. 4 is a schematic diagram in perspective illustrating an electron gun assembly alignment apparatus.

A schematic representation of an apparatus 120 for automatically aligning a multibeam electron beam gun assembly 12 is illustrated in FIG. 4. In this representation, the gun assembly 12 is mounted in a gun support assembly 84. The gun support assembly 84 is shown with an arm 122 extending therefrom. A stepping motor 124 is coupled to the arm 122 by a screw 126 for rotating the assembly 84. Activating signals for the stepping motor 124 are generated by a pulser unit 128. The pulser unit 128 also generates an activating signal for a collimated light source or laser unit 130 so that the light ray pulses are related to the stepped output of the stepping motor. The laser beam 132 output of the laser unit 130 is directed to a mirror 134 that reflects the beam toward the electron gun assembly 12. As the gun assembly 12 is rotated by the stepping motor 124, the laser beam 132 passes through the two alignment apertures 72 in the G3 grid 58 and strikes a photodiode 136 located on the opposite side of the gun assembly 12. The output of the photodiode 136 is fed into a current to voltage converter 138. The output of the converter 138 is next fed into an up-down counter 140 which thereby counts the number of laser beam pulses that pass through the apertures 72. Generally, the electron gun assembly is rotated from a position where no light rays pass through both alignment apertures, through positions where light rays do pass through both alignment apertures, to a position where again no light rays pass through both alignment apertures. Additional rotation beyond the point where no light passes through the apertures eliminates the need for any anti-backlash devices. Once the counting up of the laser pulses has been completed, the stepping motor 124 continues to step for a predetermined time where upon a signal is sent to reverse the stepping motor 124. The laser beam pulses are then counted down until half the pulses that were counted up is reached. Although the preferred embodiment has been described using a stepping motor, it should be understood that a continuous drive motor could also be used with the light pulses being in predetermined relationship with the speed of rotation.

In actual practice, a prism and two mirrors are used on the laser side of the apparatus 120 and another mirror is used on the photodiode side of the apparatus instead of the single mirror 134 shown. Furthermore, it should be realized that the rate of laser pulses could be doubled during count-down or that every other pulse could be counted during count-up if it is desired to reach zero during countdown to aid in stopping the rotation of the gun assembly.

An optical assembly 200 of the present apparatus is shown in FIGS. 5 and 6. This assembly 200 comprises a rigid base support 202 on which a first horizontal platform 204 is slidably mounted by two horizontally extending parallel rods 206. In turn, a second horizontal platform 208 is slidably mounted on the first platform 204 by two parallel horizontal rods 210 that extend perpendicular to the first rods 206. The purpose of this subassembly of two slidable platforms 204 and 208 is to permit adjustment of the assembly 200 relative to the mount sealing unit. Once positioned, the two platforms 204 and 208 are locked in place.

A laser unit 212 is vertically mounted on a first arm 214 that extends vertically from the second platform 208 so that its laser beam (shown as alternate dot-dash line 216) is directed upwardly through the laser unit lense assembly 218.

A second arm 220 extends vertically from the second platform 208 to rigidly support a vertical platform 222 therefrom. Two rods 224 are mounted horizontally on the vertical platform 222 parallel and vertically spaced from each other. The rods 224 slidably support a carriage assembly 226 which is movable toward or away from the sealing unit by a pneumatic cylinder 228 attached to the platform 222 and having its piston rod 230 attached to the carriage assembly 226. The carriage assembly 226 includes a horizontally positioned platform 232 thereon. A housing structure 234 which holds an optical mirror unit 236 and a photodetector 238 is seated on the platform 232. The mirror unit 236 is adjustably mounted in the housing structure 234 between two chocks 240 which are positioned by two facing bolts 242 that extend through the housing 234.

As previously noted, rotational motion of the gun assembly is imparted by a stepping motor. The stepping motor assembly 250 of the alignment apparatus is shown in the plan view of FIG. 7. The assembly 250 includes a vertical platform 252 on which a horizontally extending rod 254 is attached. A horizontal platform 256 also is attached to the vertical platform 252. A stepping motor 258 is slidably attached to the rod 254 by means of an arm 260 extending the side of the motor 258 which is rotationally attached to a collar 262 on the rod 254. Another arm 264 extends from the back of the motor 258. This arm 264 has a roller 266 at an end thereof that engages and rides in a groove 268 in the horizontal platform 256. This groove 268 is angled so that the stepping motor 258 will rotate to the position shown in dashed lines when it is moved to the left as shown in FIG. 7. Such movement is activated by a pneumatic cylinder (not shown) which is attached at the collar 262. In the left most position, a drive unit 270 of the stepping motor engages the adjusting knob 117 on a mount rotating fixture.

I claim:

1. A method of aligning a multibeam cathode-ray tube electron gun assembly with at least a portion of a cathode-ray tube bulb, wherein an element of said gun assembly has two accurately positioned alignment apertures therein, a line connecting the centers of the alignment apertures being transverse to the central longitudinal axis of said gun assembly, said method including:

positioning said tube bulb in known orientation relative to a light source with said gun assembly being located adjacent to said tube bulb having its central longitudinal axis substantially aligned with the central longitudinal axis of said bulb, directing light rays toward the alignment apertures from said light source, rotating said electron gun assembly about its central longitudinal axis, pulsing said light rays in predetermined relationship with the speed of rotation of said electron gun assembly, and counting a number of light pulses passing through the alignment apertures.

2. The method as defined in claim 1 wherein said electron gun assembly is rotated from a position where no light rays pass through both alignment apertures, through positions where light rays pass through both alignment apertures, to a position where again no light rays pass through both alignment apertures and thereafter the direction of rotation is reversed and the electron gun assembly is rotated back to a centered position where light rays pass through both apertures.

3. The method as defined in claim 1 including the subsequent steps of reversing the rotation of said electron gun assembly and stopping the reverse rotation when the light pulse count is one half that counted during the forward rotation.

4. The method as defined in claim 1 wherein every other light pulse is counted and including the subsequent steps of reversing the rotation of said electron gun assembly and counting all light pulses and stopping the reverse rotation when the counted light pulses equal that counted during forward rotation.

5. The method as defined in claim 1 wherein the rotation of said electron gun assembly is stepped rotation and a predetermined number of pulses occur during each step of rotation.

6. A method of automatically aligning a multibeam cathode-ray tube electron gun assembly with a cathode-ray tube bulb, wherein an electrode of said gun assembly has two accurately positioned alignment apertures therein, a line connecting the centers of the alignment apertures being transverse to the central longitudinal axis of said gun assembly, said method including:

positioning said bulb in known orientation relative to a collimated light source, holding said electron gun assembly relative to said cathode-ray tube bulb, directing collimated light from said source toward the alignment apertures, rotationally stepping the position of said electron gun assembly about its central longitudinal axis, pulsing said light source in synchronization with the steps in position of said electron gun assembly, and counting the number of light pulses passing through the alignment apertures.

7. A method of automatically aligning a multibeam cathode-ray tube electron gun assembly with a cathode-ray tube bulb, wherein an electrode of said gun assembly has two accurately positioned alignment apertures therein, a line connecting the centers of the alignment apertures being transverse to the central longitudinal axis of said gun assembly, said method including:

positioning said bulb in known orientation relative to a collimated light source, holding said electron gun assembly relative to said cathode-ray tube bulb, directing collimated light from said source toward the alignment apertures, rotationally stepping the position of said electron gun assembly about its central longitudinal axis, pulsing said light source in synchronization with the steps in position of said electron gun assembly, counting up the number of light pulses passing through the alignment apertures, reversing the stepping direction of said electron gun assembly, counting down the number of light pulses passing through the alignment apertures, and stopping the reverse rotation of said electron gun assembly when the number of counted down light pulses are half of the maximum number of light pulses counted up.

8. Apparatus for aligning a multibeam cathode-ray tube electron gun assembly with at least a portion of a cathode-ray tube bulb, wherein an element of said gun assembly has two accurately positioned alignment apertures therein, a line connecting the centers of the alignment apertures being transverse to the central longitudinal axis of said gun assembly, said apparatus including, means for holding said bulb in a specific orientation, means for directing light rays toward the alignment apertures, said means for directing being in a known orientation relative to said means for holding, means for rotating said electron gun assembly about its central longitudinal axis, means for pulsing said light rays in predetermined relationship with the speed of rotation of said electron gun assembly, and means for counting the number of light pulses passing through the alignment apertures.

9. Apparatus for automatically aligning a multibeam cathode-ray tube electron gun assembly with a cathode-ray tube bulb held in a sealing unit, wherein an electrode of said gun assembly has two accurately positioned alignment apertures therein, a line connecting the centers of the alignment apertures being transverse to the central longitudinal axis of said gun assembly, said apparatus including:

means for holding said bulb in a specific orientation, means for holding an electron gun assembly relative to said cathode-ray tube bulb, including stepping means for rotating said electron gun assembly in discrete steps about its central longitudinal axis, a collimated light source in known orientation relative to said means for holding said bulb positioned to direct light through the two electrode apertures of said gun assembly as said gun assembly is rotated by said stepping means, means for synchronizing light pulses from said light source with the steps of said stepping means, and means for counting the light pulses passing through the electrode alignment apertures.

10. Apparatus for automatically aligning a multibeam cathode-ray tube electron gun assembly with a cathode-ray tube bulb held in a sealing unit wherein an electrode of said gun assembly has two accurately positioned alignment apertures therein, a line connecting the centers of the alignment apertures being transverse to the central longitudinal axis of said gun assembly, said apparatus including:

means for holding said bulb in a specific orientation, means for holding an electron gun assembly relative to said cathode-ray tube bulb, including stepping means for rotating said electron gun assembly in discrete steps about its central longitudinal axis, a collimated light source in known orientation relative to said means for holding said bulb positioned to direct light through the two electrode apertures of said gun assembly as said gun assembly is rotated by said stepping means, means for synchronizing light pulses from said light source with the steps of said stepping means, means for counting the light pulses passing through the electrode alignment apertures, means for reversing the rotational direction of said stepping means, and means for stopping the reversed rotation of said stepping means when half of the maximum number of pulses counted during forward rotation is reached.

* * * * *